US008387989B2

(12) United States Patent
Baum

(10) Patent No.: US 8,387,989 B2
(45) Date of Patent: Mar. 5, 2013

(54) STACKING BLOCK TOWER BUILDING GAME

(76) Inventor: Keith Baum, Harvey Cedars, NJ (US)

( * ) Notice: Subject to any disclaimer, the term of this patent is extended or adjusted under 35 U.S.C. 154(b) by 0 days.

(21) Appl. No.: 12/758,063

(22) Filed: Apr. 12, 2010

(65) Prior Publication Data

US 2010/0264589 A1 Oct. 21, 2010

Related U.S. Application Data

(60) Provisional application No. 61/170,298, filed on Apr. 17, 2009.

(51) Int. Cl.
*A63F 9/12* (2006.01)
*A63F 9/20* (2006.01)

(52) U.S. Cl. ..... 273/440; 273/276; 273/156; 273/157 R

(58) Field of Classification Search ..... 273/276, 273/156, 157 R, 440, 450; 446/117, 118
See application file for complete search history.

(56) References Cited

U.S. PATENT DOCUMENTS 3,410,021 A * 11/1968 Patterson ..... 446/78
3,546,792 A * 12/1970 Sherman ..... 434/96
3,672,681 A * 6/1972 Wolf ..... 273/157 R
3,863,918 A 2/1975 Kramer
3,964,794 A * 6/1976 Scholz ..... 303/9.69
4,133,538 A * 1/1979 Ambrose ..... 273/276
4,153,254 A * 5/1979 Marc ..... 273/160
4,293,128 A 10/1981 Ebel
4,534,563 A * 8/1985 Guenther ..... 273/157 R
4,662,638 A * 5/1987 Vachek ..... 273/160
4,792,138 A * 12/1988 Watkins ..... 273/157 R
5,393,063 A * 2/1995 Ichimaru ..... 273/160
5,544,882 A * 8/1996 Sarkar ..... 273/157 R
5,560,611 A * 10/1996 Kim ..... 273/272
5,611,544 A 3/1997 Grebler et al.
5,823,533 A * 10/1998 Edwards ..... 273/160
5,868,388 A * 2/1999 Wood et al. ..... 273/157 R
5,988,640 A * 11/1999 Wheeler ..... 273/241
6,022,026 A * 2/2000 Johnson, III ..... 273/450
6,161,832 A 12/2000 Holahan et al.
6,196,544 B1 * 3/2001 Rachofsky ..... 273/157 R
6,648,330 B2 * 11/2003 Porter ..... 273/153 R
6,679,496 B2 1/2004 Grebler et al.
6,702,285 B2 * 3/2004 Cheng ..... 273/153 R
7,040,621 B2 * 5/2006 Cheng ..... 273/160
7,059,606 B2 6/2006 Butcher et al.
7,140,612 B2 * 11/2006 Chen ..... 273/156
7,677,567 B2 * 3/2010 Chen ..... 273/157 R
7,900,930 B2 * 3/2011 Donegan et al. ..... 273/450
2002/0121739 A1 * 9/2002 Sum ..... 273/156
2004/0063080 A1 * 4/2004 Cheng ..... 434/208

* cited by examiner

*Primary Examiner* — William Pierce
(74) *Attorney, Agent, or Firm* — Fox Rothschild LLP; Richard C. Woodbridge; Ryan Miller

(57) ABSTRACT

A multi-player, multi-level stacking block game is formed from cubes of non-uniform size and is scored in such a fashion as to reward bold play but penalize the player that causes the stacked tower to fall down. The game includes 72 pieces which comprise six (6) sets of 12 pieces each. A player is selected to begin and rolls a die to determine which piece he or she plays. The piece is placed on a 3×3 grid having 9 squares. Players ultimately take turns placing a piece on the grid, and above it, until the tower either falls down or, if all 72 pieces are used, the player with the highest score wins. The playing pieces are uniquely structured so that at least one dimension of the subset of player pieces is not a multiple of another piece in that subset in order to enhance the instability factor of the game. The score that the player receives is an accumulation of the scores based upon piece location and how many levels a player piece occupies as well as if the player can occupy all 9 cubes on a particular level.

5 Claims, 14 Drawing Sheets

STACKING BLOCK TOWER BUILDING GAME

CROSS REFERENCE TO RELATED APPLICATIONS

This application claims the priority of U.S. Provisional Application Ser. No. 61/170,298 entitled "STACKING BLOCK GAME" filed on Apr. 17, 2009, the entire contents and substance of which are hereby incorporated in total by reference.

FIELD OF THE INVENTION

The present invention involves a multi-player game which is played with wooden pieces of several different shapes designed to fit together to build a tower.

BACKGROUND OF THE INVENTION

Wooden blocks have been around for a long time. They are generally considered a safe and entertaining way for children and, occasionally, adults to play. They also serve an educational purpose as well. In addition to helping develop a child's imagination, research has found that playing with toy blocks has a strong link to literacy development. A recent study reported in the October 2007 issue of Archives of Pediatrics & Adolescent Medicine shows a strong association between playing with building blocks and a significant increase in language scores in young children. On average, children who played with blocks scored 15 percent higher on their language assessment than those who did not. Researchers speculate that such a measurable increase is partly due to creative block play replacing other time spent in activities that do not encourage language development, such as watching television. They also maintain that child and parent playing together remains the strongest way of promoting a child's development.

Games involving stackable blocks and tower building are well represented in the marketplace. Many involve a common theme; starting with a cuboid tower and subsequently removing pieces and replacing them on the top of the tower. Play continues until the tower falls due to removal of a key piece or poor placement of that same piece. Some examples include, but are not limited to: Milton Bradley's game sold under the trademark JENGA, U.S. Pat. No. 7,059,606 to S. W. Butcher "GAME PLAYING METHODS AND GAME PIECE STACK FORMATIONS FOR PLAYING SAME", U.S. Pat. No. 6,679,496 to R. Grebler "ACTIVITY-DIRECTED STACKING PIECE GAME" and U.S. Pat. No. 5,611,544 to R. K. Grebler "STACKING BRICK TOWER GAME". These games all provide a similar game playing experience.

There are also games involving the stacking of blocks to complete a tower or a desired shape. These include U.S. Pat. No. 3,863,918 to G. A. Kramer "BUILDING BLOCK GAME", U.S. Pat. No. 4,293,128 to J. C. Ebel "CENTER OF GRAVITY-APPRAISAL BLOCK GAME" and U.S. Pat. No. 6,161,832 to E. T. Holahan "STACKING BLOCK GAME". These games employ blocks of different shapes and sizes and varying rules for their placement.

Although these games have some similarities to the present invention, none of the games incorporate a plurality of differently shaped blocks specifically designed to create a tower of ever-increasing instability without any removal or replacement of pieces, combined with a score-based incentive and the use of a die, all while providing an environment where no two games are played exactly the same.

SUMMARY OF THE INVENTION

The present invention provides for a high level of manual dexterity, analytical thinking, 3D spatial reasoning and mathematical ingenuity. The placement of each piece is critical to the stability of the tower and the ultimate score for that player. The intentional imperfection in the structure of the blocks allows for a high degree of excitement as the resulting tower becomes more and more unstable. The player must consider "score vs. stability" when placing a piece for that turn. It is of the utmost importance to maintain tower stability during a player's turn; if the tower falls, that player loses the game.

Briefly described, the invention comprises 12 uniquely shaped pieces, 6 of each individual shape, for a total of 72. Hardwood is the preferred material due to its coefficient of friction. The pieces are based on a cuboid with 1.8 cm×1.8 cm×1.9 cm dimensions. The 12 shapes are achieved by combining the base piece in various arrangements. Each piece has a corresponding number, 1 through 12, relating to one of the 12 sides of a 12-sided die.

These pieces are made in such a way that they don't fit exactly together as to provide a level of instability in the resulting tower, causing an increasing chance of collapse. The choice of which piece to play is decided by rolling a 12-sided die. Placement and orientation of each piece yields a numerical score for each player which ultimately determines the winner of the game. The game ends when all pieces have been used or, more likely, the tower falls. The player whose turn it is when the tower falls is the loser and the player with the highest score (when more than 2 players are playing) is declared the winner.

It is important to note that the pieces do not fit precisely together; they are structured to have gaps when combined. These gaps are responsible for the resultant instability of the tower.

The block tower is based on a 3 unit by 3 unit grid design. As the tower is being built all levels need not be completely filled in to begin placing pieces on the next level, but no part of any piece may extend beyond the 3×3 matrix.

Players place pieces on the tower based on the results of throwing a 12-sided die.

The invention may be more fully understood by referencing the following drawings.

BRIEF DESCRIPTION OF DRAWINGS

FIG. 2*a* illustrates pieces Nos. 1-3, which comprise the basic blocks that all the other pieces are made from.

FIG. 6 series illustrates scoring with respect to piece placement. Piece No. 12 has been used.

FIG. 7-9 series illustrates the scoring involved when one or more levels of the tower are completed (all available positions are filled in).

FIGS. 8*a* through 8*d* illustrate a sample tower, with two levels being completely filled in and piece No. 2 has been used wherein FIG. 8*a* illustrates a typical tower after several pieces have been placed; FIG. 8*b* illustrates the same tower rotated 180° for reference; FIG. 8*c* illustrates the tower with a new piece added, renamed; and, FIG. 8*d* illustrates the same tower rotated 180° for reference.

FIGS. 9*a* through 9*d* illustrate a sample tower, with three levels being completely filled in and piece No. 3 has been used, wherein: FIG. 9*a* illustrates a typical tower after several pieces have been placed; FIG. 9*b* illustrates the same tower rotated 180° for reference; FIG. 9*c* illustrates the tower with a new piece added, renamed; FIG. 9*d* illustrates the same tower rotated 180° for reference;

DETAILED DESCRIPTION OF THE PREFERRED EMBODIMENT

Figure 1:
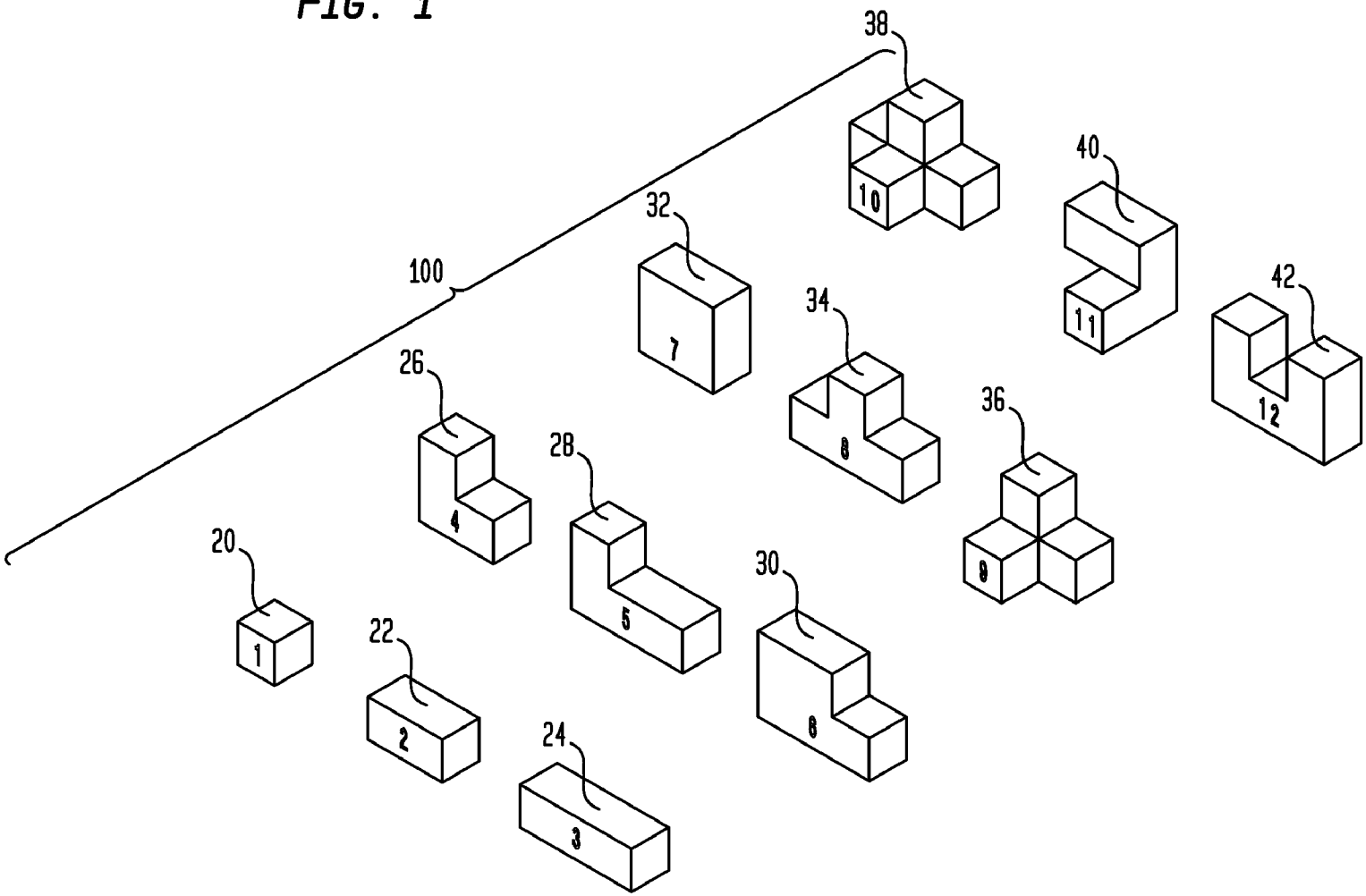
FIG. 1 shows the entire set of 12 unique blocks according to the preferred embodiment of the invention.

The present disclosure describes a game that involves several unique characteristics, combined to provide an improved gaming experience in the stacking block/tower building category. The preferred embodiment employs game pieces made from hardwood. There are 12 distinct pieces as referenced by FIG. 1; all designed using the three basic pieces seen in FIG. 2*a*, (20, 22, 24). Although there are more than 12 unique possibilities for combining the basic pieces, the current game is limited to 12. Some combinations have been tested and not included in this disclosure due to excess complexity, difficulty of placement on the tower and ambiguity, i.e. a minor image of piece No. 11 (40) would be hard to distinguish from the original piece.

As can be seen, the pieces become more complex as the different permutations of the basic building block pieces are used (20, 22, 24) which are designated pieces Nos. 1-3, respectively. All remaining pieces are based on—and assembled using—these blocks (20, 22, 24).

Figure 2A:
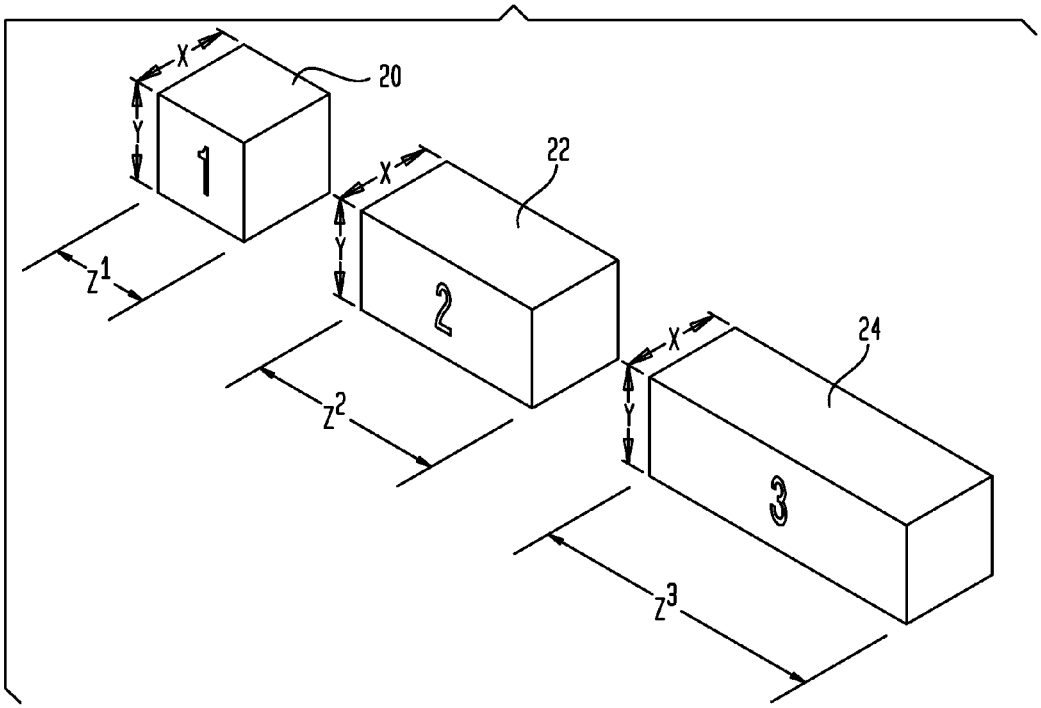
Figure 2B:
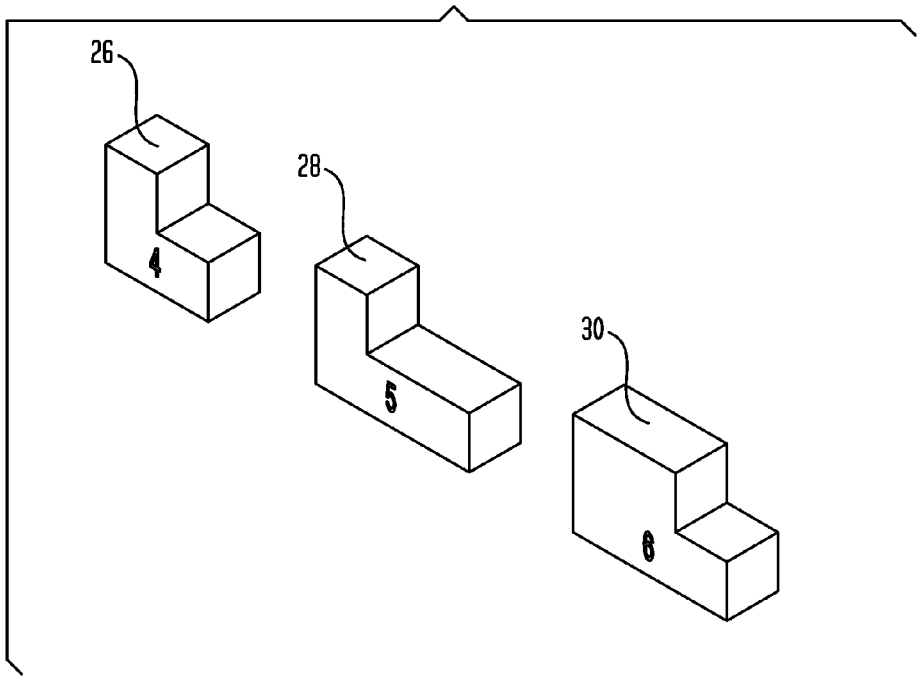
FIG. 2*b* illustrates pieces Nos. 4-6 which are created by attaching some of the basic blocks from FIG. 2*a* together.
Figure 2C:
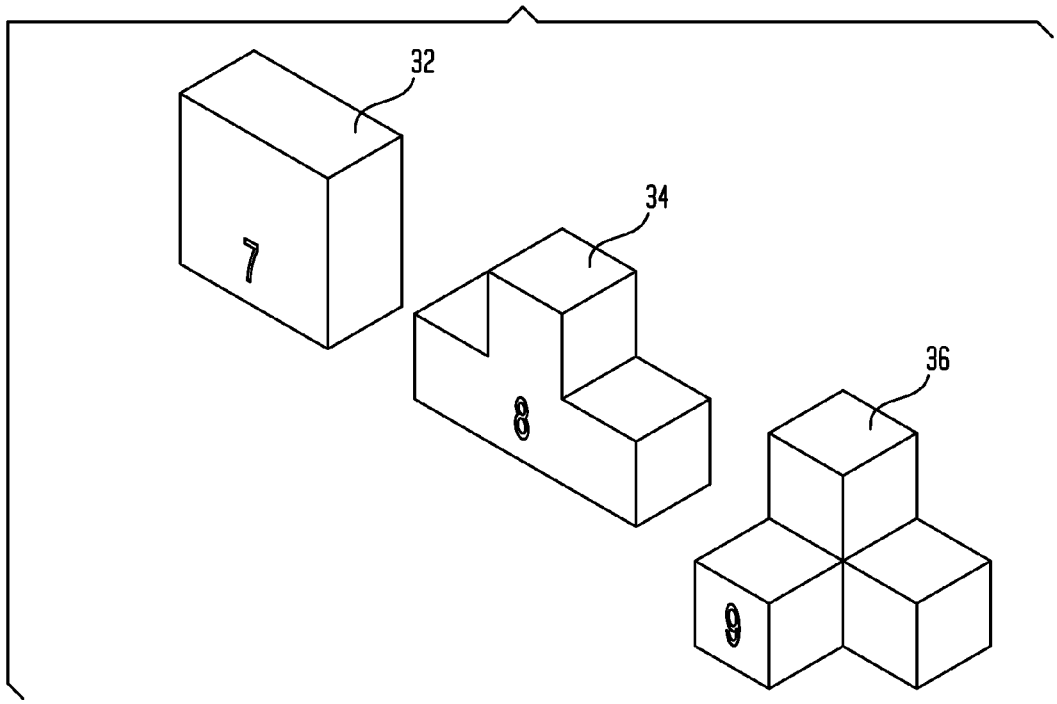
FIG. 2*c* illustrates pieces Nos. 7-9 which are created by attaching blocks from FIG. 2*a* together.
Figure 2D:
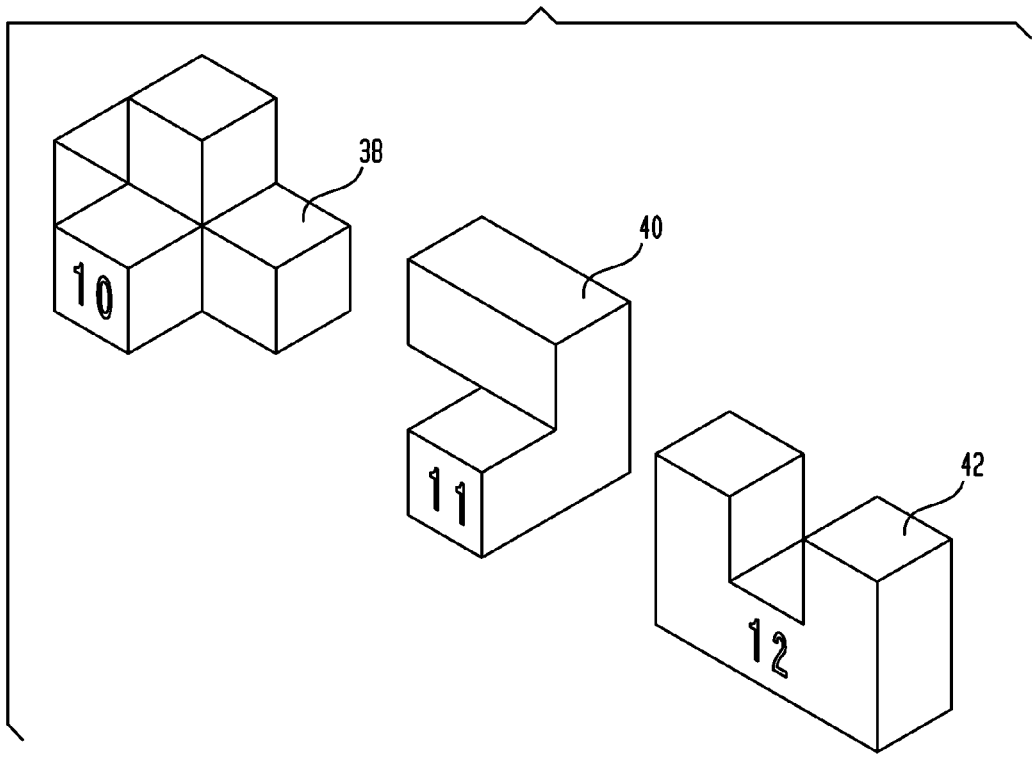
FIG. 2*d* completes the series by illustrating pieces Nos. 10-12 by attaching blocks from FIG. 2*a* together.
Figure 3:
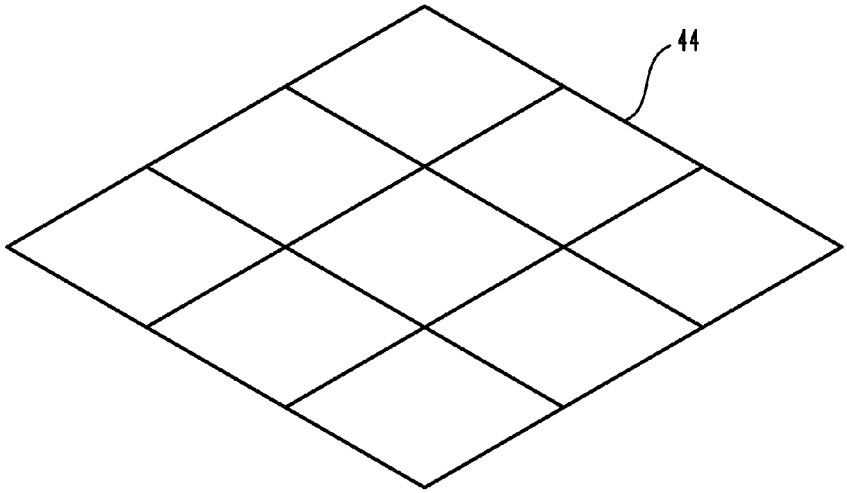
FIG. 3 illustrates an imaginary 3×3 grid used when building the tower.
Figure 4A:
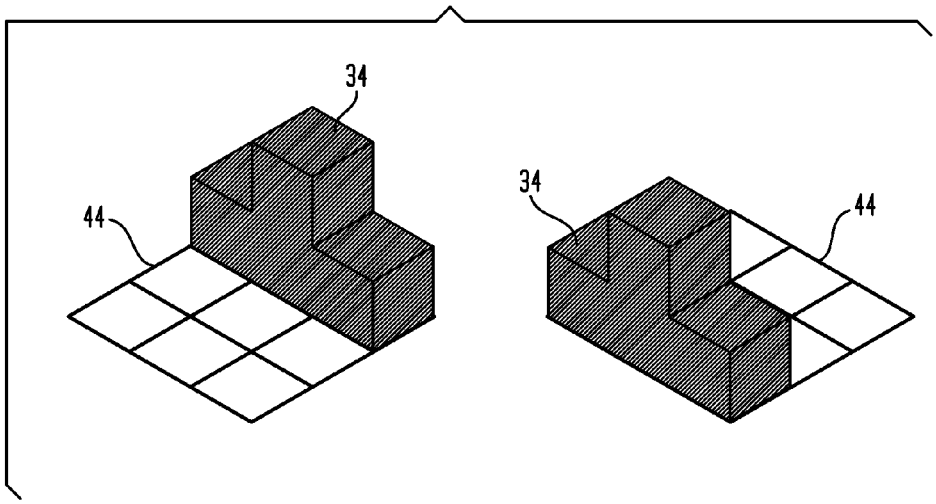
FIG. 4*a* illustrates the grid with a first piece placed; piece No. 8 has been arbitrarily used. A 180° rotated view has been included for clarity.
Figure 4B:
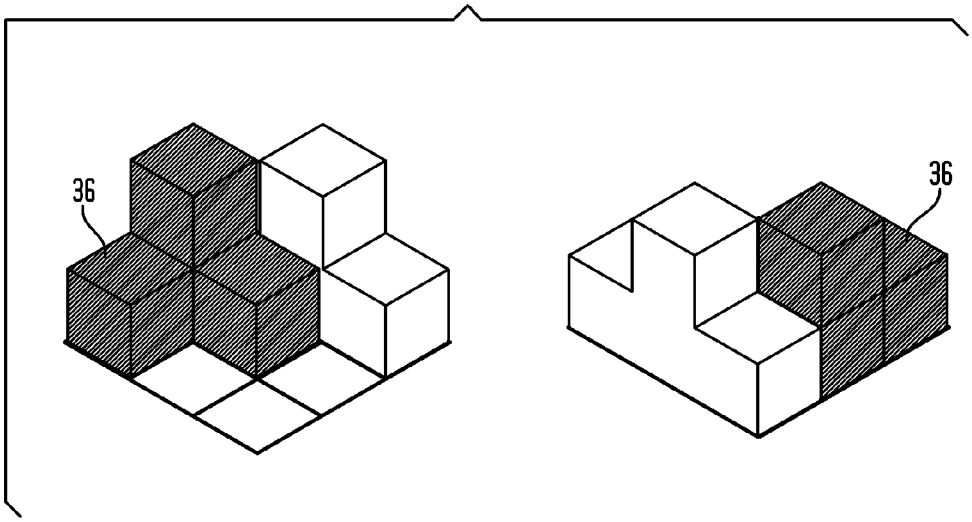
FIGS. 4*b* through 4*i* illustrate the next several moves in a typical game. The piece being added has been highlighted for reference. A 180° rotated view has also been included for clarity.
Figure 4C:
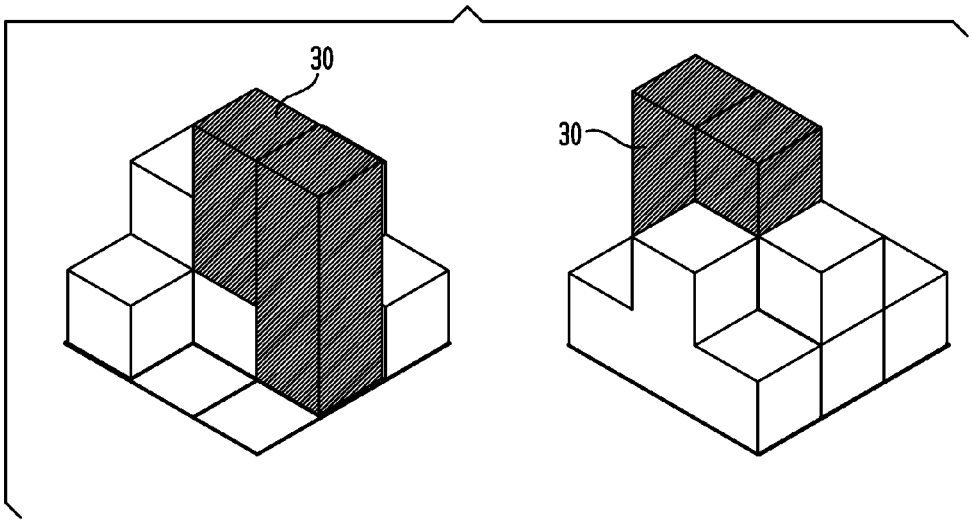
Figure 4D:
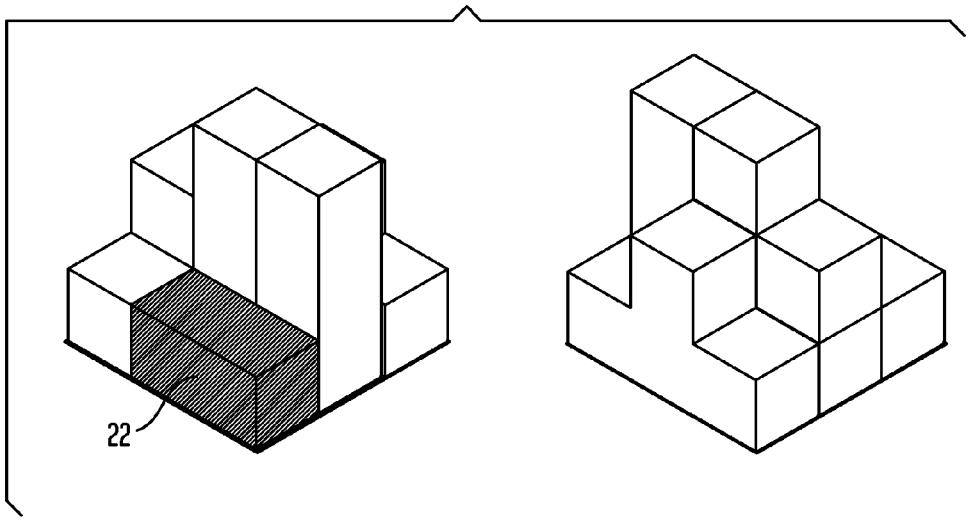
Figure 4E:
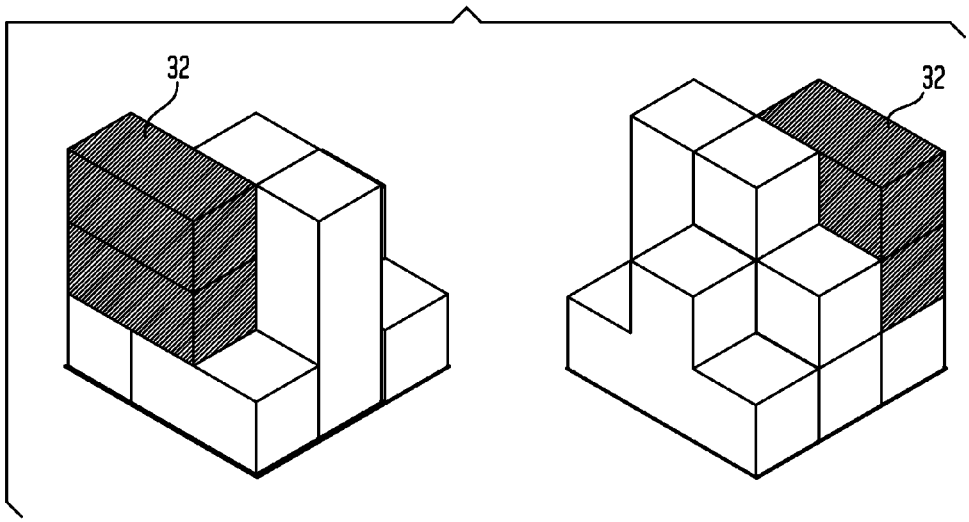
Figure 4F:
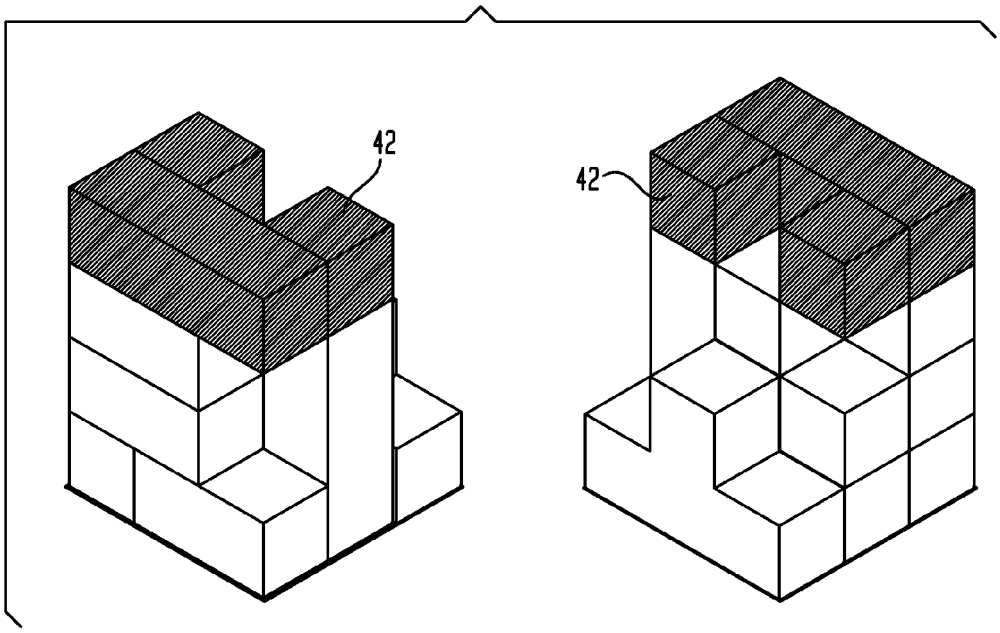
Figure 4G:
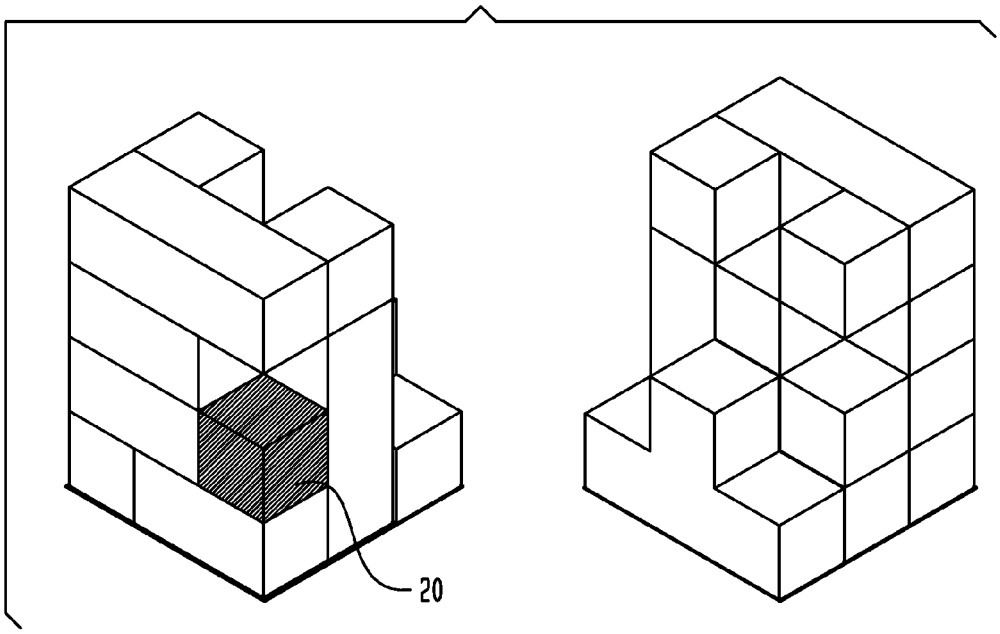
Figure 4H:
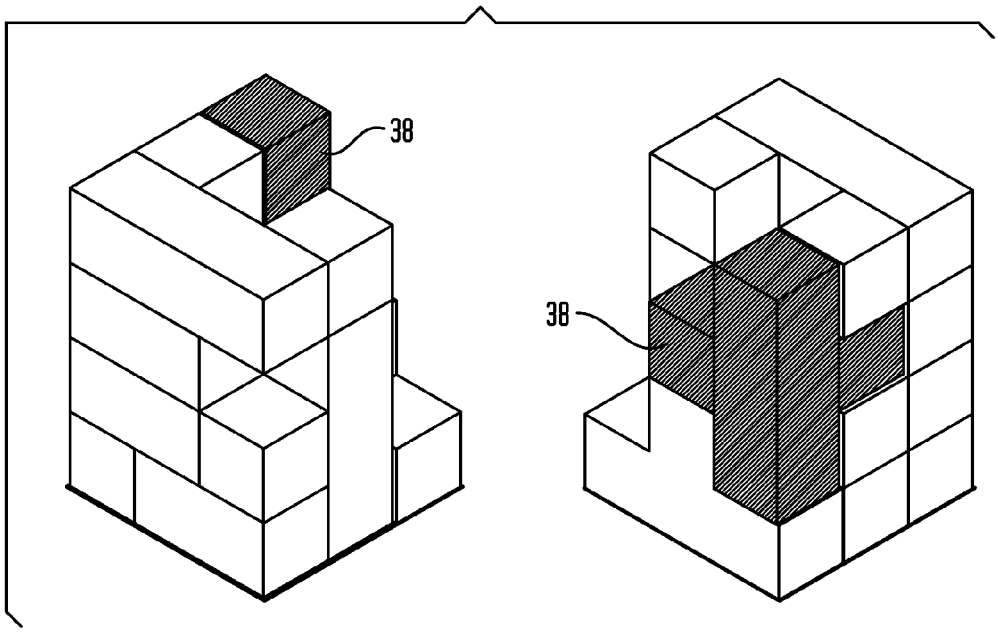
Figure 4I:
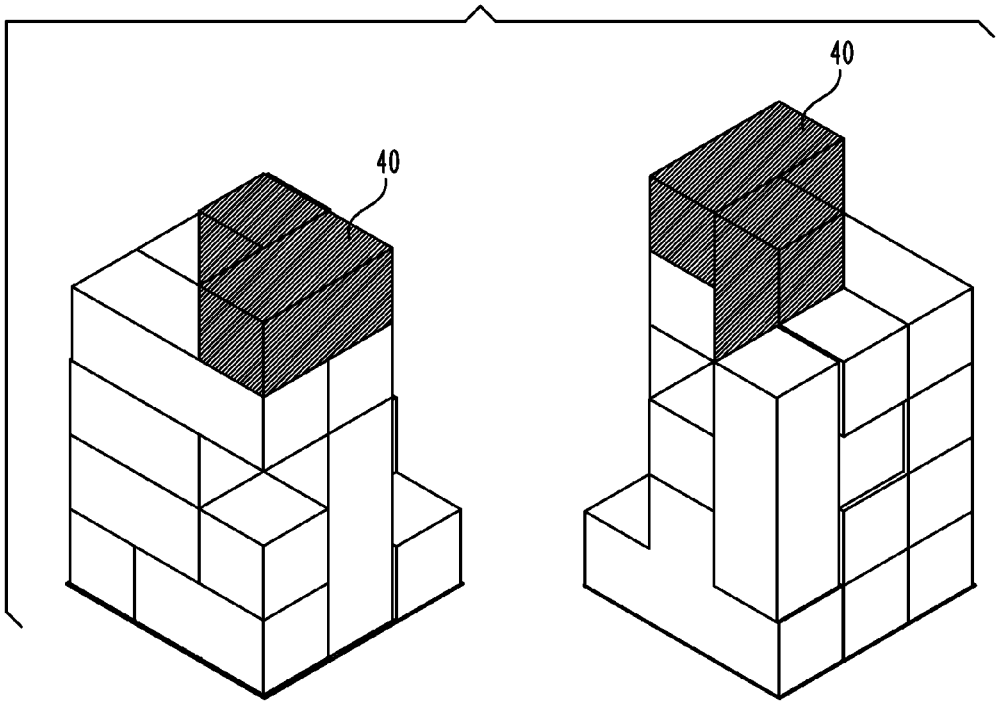

The pieces illustrated in FIG. 2*b*, (26, 28, 30) are assembled combining the aforementioned pieces from FIG. 2*a*, in the following manner:

Item 26, designated piece No. 4, is made by adding 20 to 22;

Item 28, designated piece No. 5, is made by adding 20 to 24;

Item 30, designated piece No. 6, is made by adding 22 to 24;

The pieces illustrated in FIG. 2*c*, (32, 34, 36) are also assembled combining pieces shown in FIG. 2*a*, in the following manner:

Item 32, designated piece No. 7, is made by adding 22 to 22;

Item 34, designated piece No. 8, is made by adding 20 to 24, placing 20 atop the centerline of 24;

Item 36, designated piece No. 9, is made by adding 20 to 22, forming an "L" shape and adding an additional 20 atop at the crux;

FIG. 2*d* illustrates the most complicated pieces in the series, again assembled using the pieces in FIG. 2*a*, in the following manner:

Item 38 is assembled similar to 34, shown in FIG. 2*c* with the addition of 20 attached along the centerline of the piece, 90° from the placement of the original 20 used for item 34;

Item 40 incorporates two of the same pieces, 22, connected atop each other at a 90° angle; Item 42 is assembled using 24 with the addition of 2 pieces, 20, attached atop; aligned at the extremes of the original piece.

The game is played and scored as follows:

The game begins by sorting the pieces into groups of similar shape. This will help in locating the correct piece for placement in the future. Players decide who goes first and that player throws a 12-sided die. The player then locates the corresponding piece and places it on the playing area. The player may have several options for placing the piece depending on which piece is being used.

Figure 5:
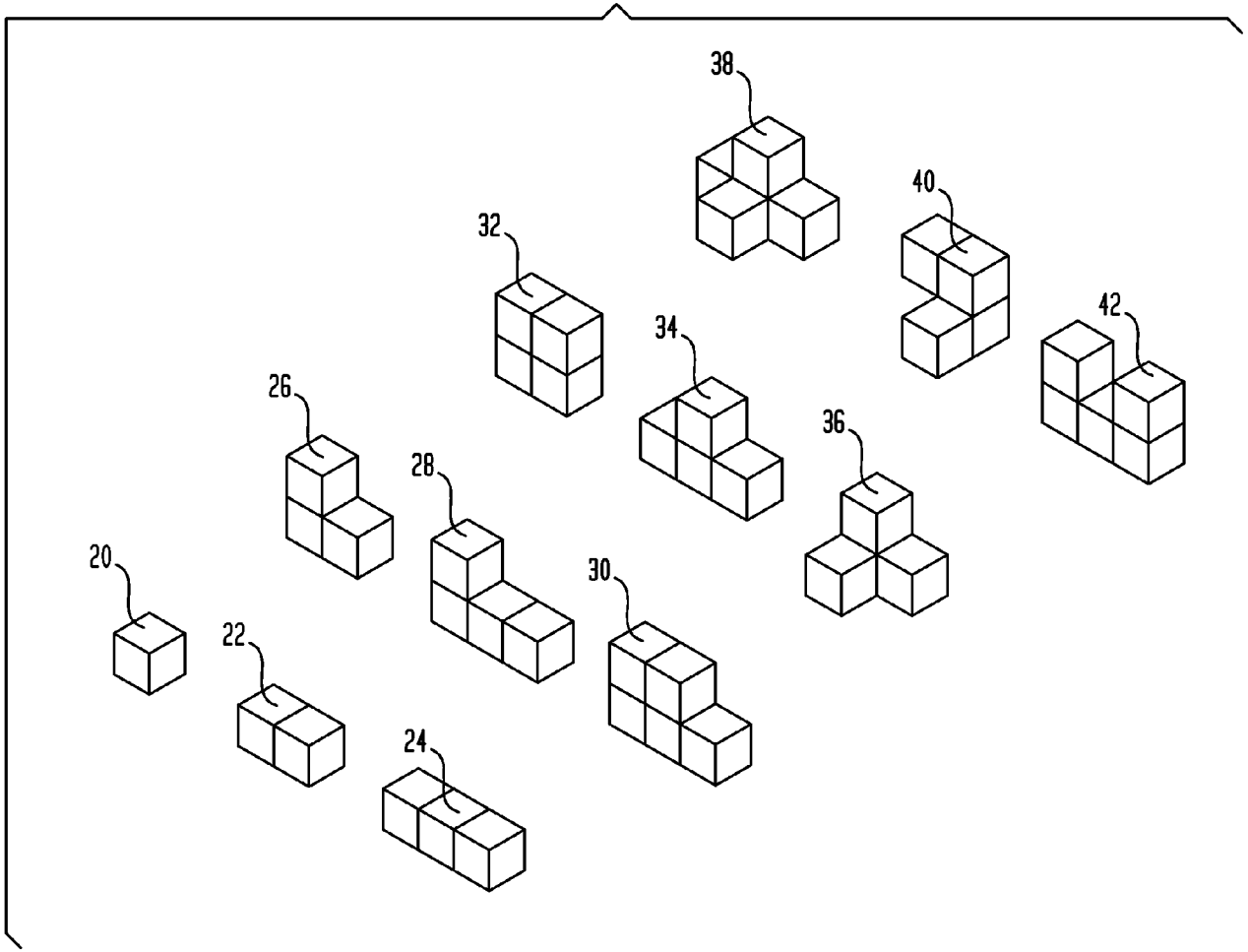
FIG. 5 illustrates all game pieces with segmentation lines added to show the units involved in each piece for scoring purposes.

A player's score for placing a piece involves several factors. Each piece is comprised of a number of units based on piece #1 (20). In FIG. 5, lines have been added to show the unit count for each piece. The values are as follows:

Item 20, designated piece No. 1, has one unit;
Item 22, designated piece No. 2, has two units;
Item 24, designated piece No. 3, has three units;
Item 26, designated piece No. 4, has three units;
Item 28, designated piece No. 5, has four units;
Item 30, designated piece No. 6, has five units;
Item 32, designated piece No. 7, has four units;
Item 34, designated piece No. 8, has four units;
Item 36, designated piece No. 9, has three units;
Item 38, designated piece No. 10, has five units;
Item 40, designated piece No. 11, has four units;
Item 42, designated piece no. 12, has five units.

The unit count and the orientation of each piece makes up the "placement" portion of the score.

Scoring involves adding the total units on each level. A single piece may have units on up to three different levels. Units on the first level count for one point each. Units on the second level count for two points each. Units on the third level count for three points each.

The following illustrations should provide a better understanding of this facet of the scoring.

Figure 6A:
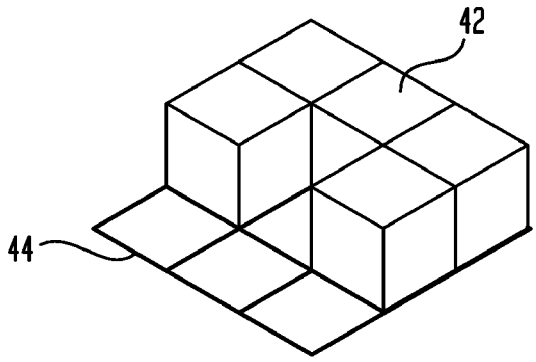
FIG. 6*a* explains scoring when piece No. 12 is placed fiat on the playing area.
Figure 6B:
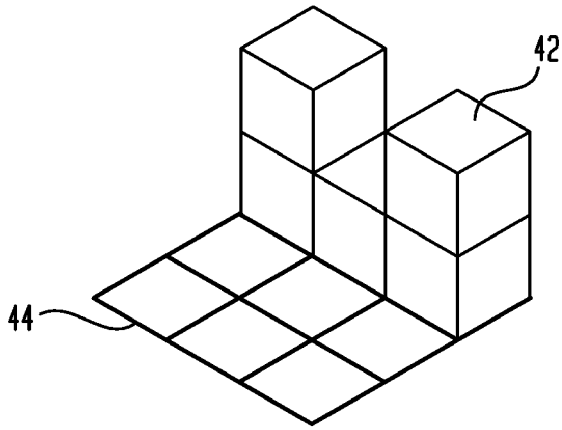
FIG. 6*b* shows placement of the same piece in a more upright fashion.
Figure 6C:
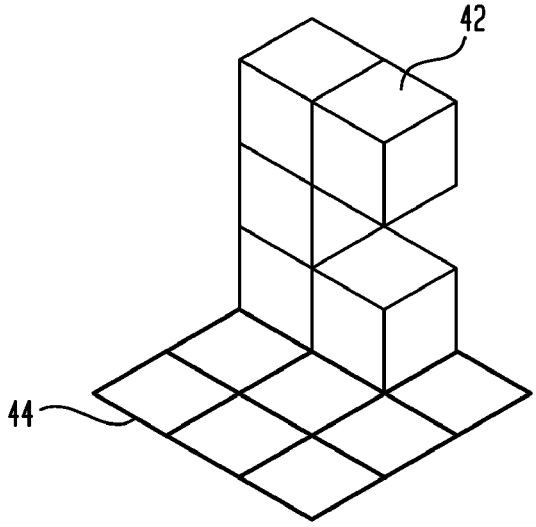
FIG. 6*c* shows placement of the same piece vertically.

FIGS. 6*a* through 6*c* show the scoring options for initial placement of piece no. 12 (42).

FIG. 6*a* illustrates the piece no. 12 (42) placed flat. The score for this placement is 5, one point for each unit on the first level.

FIG. 6*b* illustrates the piece no. 12 (42) placed in a more upright position. The score for this placement is seven, one point for each of the three units on the first level and two points for each of the units on the second level.

FIG. 6*c* illustrates the piece placed completely vertically. The score for this placement is 10, one point for each of the two units on the first level, two points for the unit on the second level and three points each for the units on the third level.

The second factor involved in scoring concerns whether a 3×3 matrix (level) is completed with the placement of the piece. "Completed" means that the level has no empty spaces; all nine places have been filled in. If the piece completes one or more levels, there is a bonus for each level completely filled in. Completing one level in a turn adds three points. Completing two levels adds nine points (three points for the first level, six points for the second). Completing three levels with one piece placement will add 18 points (three points for the first level, six points for the second and nine points for the third). The number of units on each level is not important for this part of the score nor is position on the tower of the level(s) completed.

The following illustrations should provide a better understanding of this facet of the scoring.

FIGS. 7*a* through 7*d* illustrate the scoring involved when placing a piece that completes one level.

Figure 7A:
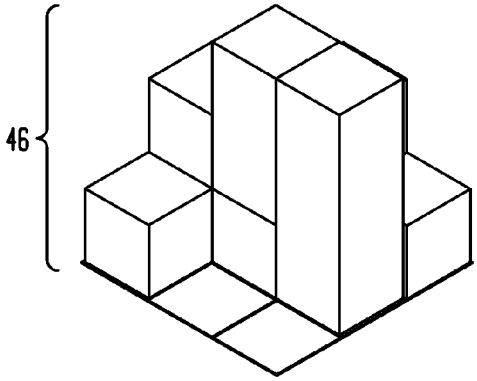
FIG. 7*a* illustrates a typical tower after several pieces have been placed.

FIG. 7*a* illustrates a typical tower 46 after several pieces have been placed.

Figure 7B:
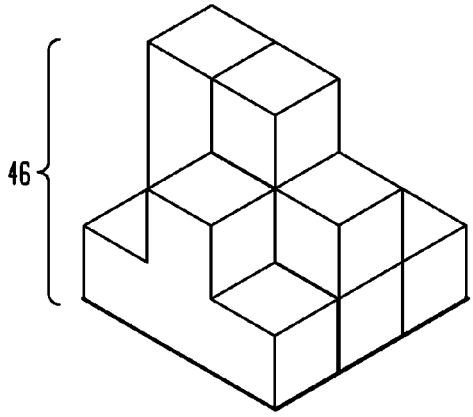
FIG. 7*b* illustrates the same tower rotated 180° for reference.

FIG. 7*b* illustrates the same tower 46 rotated 180° for reference.

Figure 7C:
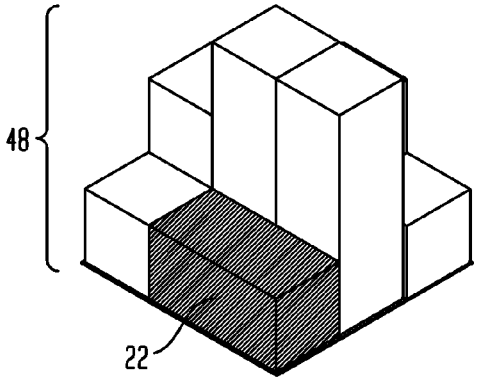
FIG. 7*c* illustrates the tower with a new piece added, renamed; and, FIG. 7*d* illustrates the same tower rotated 180° for reference.

FIG. 7*c* illustrates the tower 46 with a new piece no. 2 (22) added, renamed 48. The addition of the new piece 22 completes the first level of the tower; all nine spaces are filled in. The score for this turn is five points; two points for the placement portion of the score, one point per unit, as referenced above, and three points for completing one level of the tower.

Figure 7D:
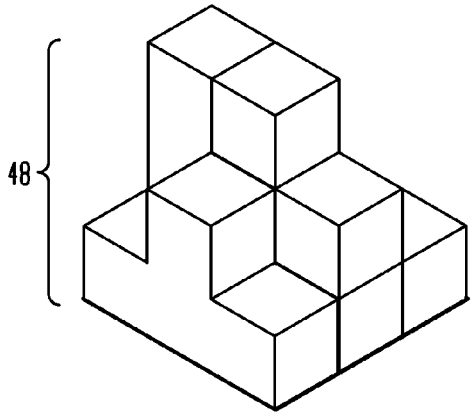

FIG. 7*d* illustrates the same tower 48 rotated 180° for reference.

FIGS. 8*a* through 8*d* illustrate the scoring involved when placing a piece that completes two levels.

Figure 8A:
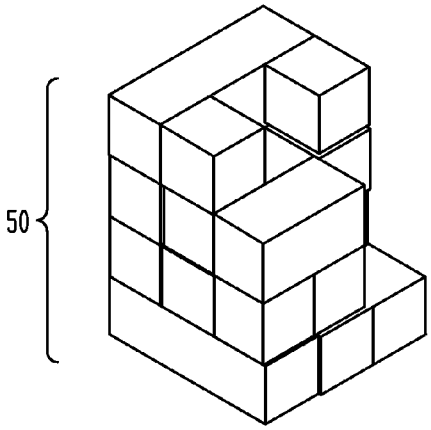

FIG. 8*a* illustrates a typical tower 50 after several pieces have been placed.

Figure 8B:
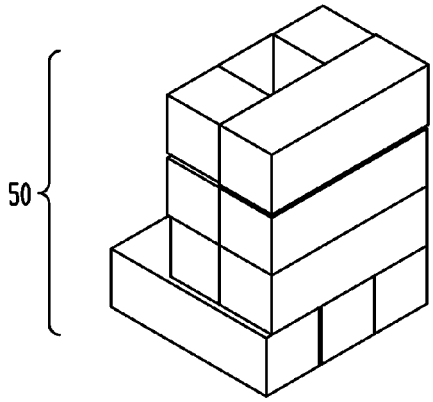

FIG. 8*b* illustrates the same tower 50 rotated 180° for reference.

Figure 8C:
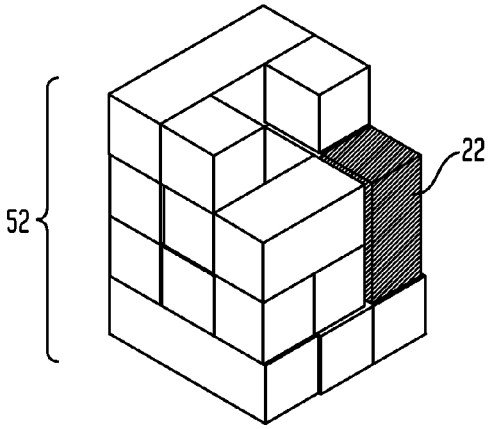

FIG. 8*c* illustrates the tower 50 with a new piece no. 2 (22) added, renamed 52. The addition of the new piece 22 completes the second and third level of the tower; all nine spaces are filled in on both level two and three. The score for this turn is 12. Placing the piece 22 vertically yields three points; one point for each unit on the lowest level (1×1=1) plus two points for each unit on the next higher level (2×1=2) providing three points for the placement portion of the score, as referenced above. An additional nine points are awarded for level(s) completion; three points for completion of one level and six points for completion of a second level for a total of nine. The final score for this turn is 12; three for piece placement plus nine for level(s) completion.

Figure 8D:
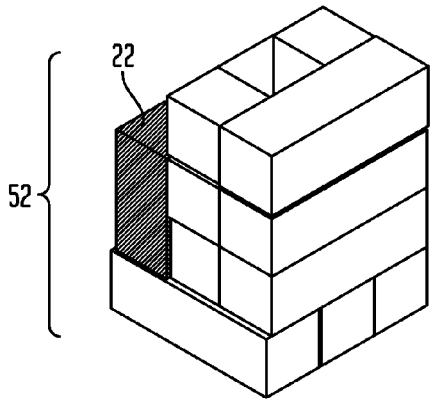

FIG. 8*d* illustrates the same tower 52 rotated 180° for reference.

FIGS. 9*a* through 9*d* illustrate the scoring involved when placing a piece that completes three levels.

Figure 9A:
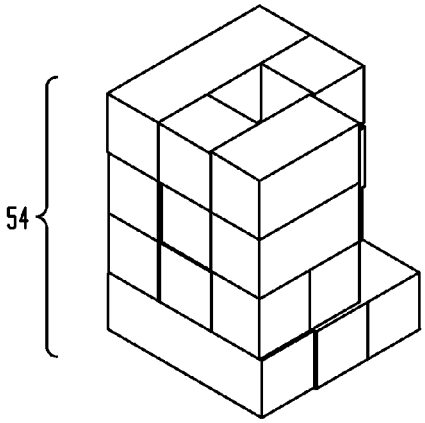

FIG. 9*a* illustrates a typical tower 54 after several pieces have been placed.

Figure 9B:
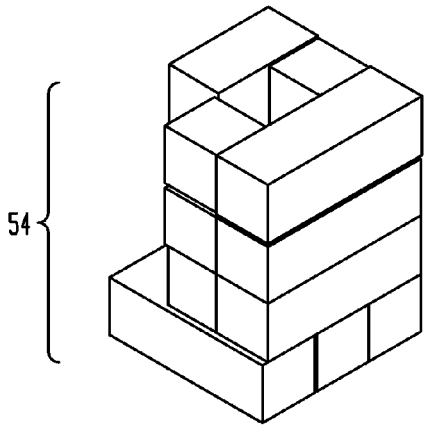

FIG. 9*b* illustrates the same tower 54 rotated 180° for reference.

Figure 9C:
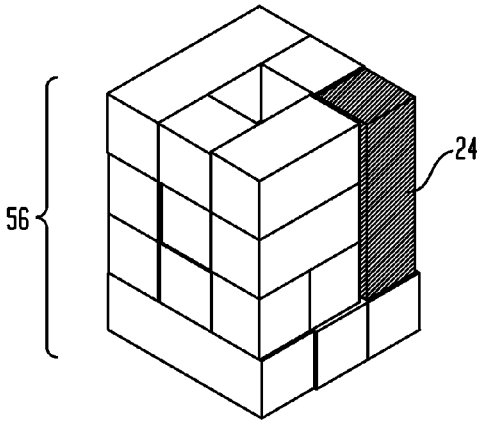

FIG. 9*c* illustrates the tower 54 with a new piece no. 3 (24) added, renamed 56. The addition of the new piece 24 completes the second, third and fourth levels of the tower; all nine spaces are filled in on level two, three and four. The score for this turn is 24. Placing the piece vertically yields six points; one point for each unit on the lowest level (1×1=1) plus two points for each unit on the next higher level (2×1=2) and finally three points for each unit on the highest level (3×1=3) providing six points for the placement portion of the score, as referenced above. An additional 18 points are awarded for level(s) completion; three points for completion of one level, six points for completion of a second level and nine points for completion of a third level for a total of 18. The final score for this turn is 24; six for piece placement plus 18 for level(s) completion.

Figure 9D:
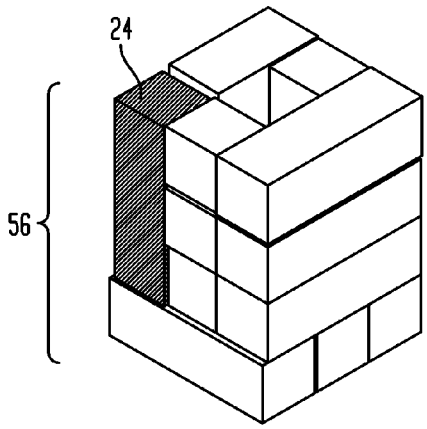

FIG. 9*d* illustrates the same tower 56 rotated 180° for reference.

Figure 10:
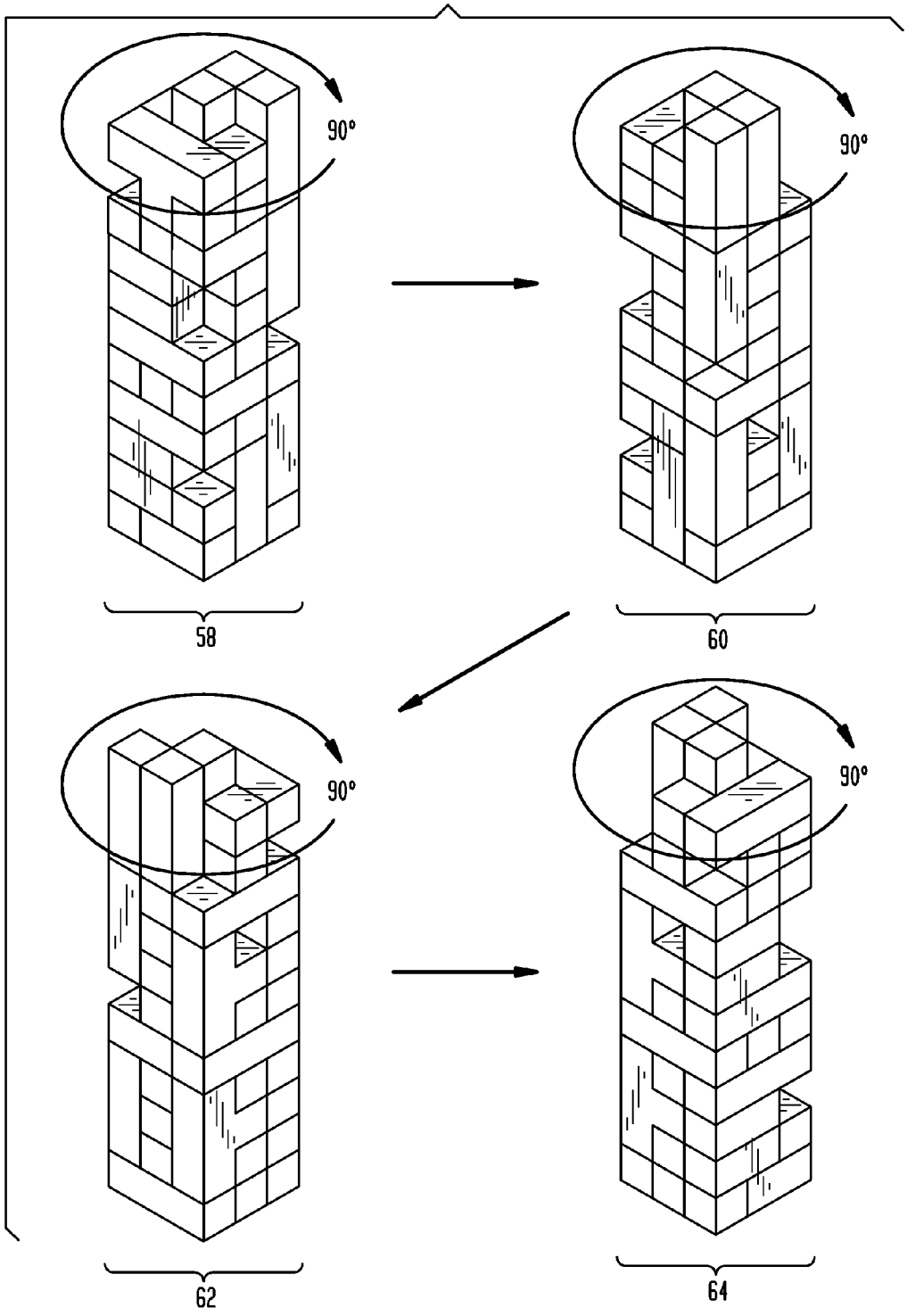
FIG. 10 illustrates a typical tower with 24 pieces randomly placed. This represents ⅓ of the total number of pieces included in the game as presented and 90°, 180°, and 270° rotated views are included for clarity.

FIG. 10 illustrates a typical tower 58 with 24 pieces randomly placed, as would happen using the 12-sided die. This represents ⅓ of the total number of pieces included in the game as presented and is representative of a tower after 24 turns. Included for clarity are a 90° (60), a 180° (62) and a 270° (64) clockwise rotated view.

It can clearly be seen that there are several levels that have been completely filled in and several which have not. A tower of this size begins to show quite a degree of instability due to the uneven dimensions of the pieces and the fact that some levels are not complete. Careful thought concerning the placement of each piece is required at this time. A player must decide between increased tower stability and a higher score for placement of the piece. Should the tower fall on that player's turn, the game is over and that player loses.

The basic dimensions of the blocks used in the game are important and have been carefully determined by field testing. The preferred dimensions of the pieces are as follows:

X=18 mm,
Y=19 mm,
$Z^1$=18 mm,
$Z^2$=37 mm,
$Z^3$=56 mm as referenced in FIG. 2*a*

These dimensions have been tested and shown to provide the best playing experience. When the pieces are too uniform i.e. based on a perfect cube (18 mm×18 mm×18 mm), the resultant tower is too stable. This stability decreases the chance of the tower collapsing and therefore the level of excitement during the game decreases.

On the contrary, if the pieces are too far from perfect, the tower becomes excessively unstable too early in the game. This situation causes frustration for the players when placing their specific piece.

After testing, it was determined that a 5%+/−deviation on one or two axes affords the best game play.

The base dimension (18 mm in this example) can be adjusted up or down for different versions of the game. Increasing to 25 mm or so is useful for smaller children, the handicapped or the elderly. Lowering the dimension to around 12 mm to 13 mm, thereby taking up less space, is useful for a travel version of the game.

With the foregoing in mind, the preferred range of dimensions of said pieces are:

X=12 mm to 25 mm
Y=13 mm to 26 mm
Z=12 mm to 75 mm

The previous description illustrates the basic game. Game variations may be added for a better playing experience.

For added variety and more uncertainty, a second die (standard 6-sided), may be added. Players roll both dies each turn. The 12-sided die still decides which piece is to be placed. The six-sided die chooses between the following options:

1. Lose a turn
2. Pick a piece (player chooses piece, disregard 12-sided die)
3. Place two pieces (player rolls 12-sided die a second time)
4. Double score for this turn
5. Deduct this turns score from player's total score
6. Play a standard turn, no changes to original rules A die with a greater number of sides can also be employed for more options during a players turn.

For smaller children, the handicapped or the elderly, a version of the game with larger pieces can be helpful. Limiting the game pieces to eight or nine of the more basic shapes simplifies piece identification and placement; also a less complicated version of scoring is used.

For advanced players and game aficionados, a version of the game with smaller pieces may be desired. The smaller shapes take up less space, allowing the game to be transported easier. The smaller pieces also require a higher level of manual dexterity during placement.

While the invention has been described with reference to the preferred embodiment thereof, it will be appreciated by those of ordinary skill in the art that modifications can be made to the structures and elements of the invention without departing from the spirit and scope of the invention as a whole.

I claim:

1. A multi-player, multi-level stacking block game apparatus comprising:

(a) a 3×3 playing grid having 9 playing squares thereon;

(b) a plurality of playing pieces taken from a plurality of sets of 6-12 uniquely shaped playing pieces, said playing pieces each having dimensions aligned along orthogonal x, y and z axes, and each playing piece having x, y and z dimensions that are multiples of a basic length, with the length of at least one axis being longer or short by 5% of the basic length;

wherein, a score is calculated based upon:

(i) the number of cubes in said playing piece; and, (ii) how many levels a particular playing piece occupies, wherein the score for playing on more than one level is a multiple of the score of playing on a single level, and wherein a decision of where to place said playing piece is made weighing score against stability.

2. The apparatus of claim 1 wherein no playing piece has a dimension longer than three playing square in a row.

3. The apparatus of claim 2 wherein each playing piece has a dimension that falls within the following ranges:

X=12 mm to 25 mm

Y=13 mm to 26 mm

Z=12 mm to 75 mm.

4. The apparatus of claim 3 wherein the preferred dimension of the playing pieces are:

X=18 mm

Y=19 mm $Z^1$=18 mm $Z^2$=27 mm $Z^3$–56 mm.

5. The apparatus of claim 3 wherein Y is between 95% of X to 105% of X but not X.

* * * * *